US011695230B2

(12) United States Patent
Liu et al.

(10) Patent No.: US 11,695,230 B2
(45) Date of Patent: Jul. 4, 2023

(54) CONNECTOR INCLUDING A TERMINAL WITH A PAIR OF SUB-TERMINALS

(71) Applicant: Tyco Electronics (Shanghai) Co. Ltd., Shanghai (CN)

(72) Inventors: Jiaoyong Liu, Shanghai (CN); Jie Luo, Shanghai (CN); Guangming Zhao, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 15 days.

(21) Appl. No.: 17/235,277

(22) Filed: Apr. 20, 2021

(65) Prior Publication Data

US 2021/0328376 A1 Oct. 21, 2021

(30) Foreign Application Priority Data

Apr. 20, 2020 (CN) ..... 202010311900.3

(51) Int. Cl.
*H01R 13/187* (2006.01)
*H01R 4/28* (2006.01)
*H01R 25/16* (2006.01)

(52) U.S. Cl.
CPC ..... *H01R 13/187* (2013.01); *H01R 4/28* (2013.01); *H01R 25/162* (2013.01)

(58) Field of Classification Search
CPC ..... H01R 13/187; H01R 13/18; H01R 13/15; H01R 13/114; H01R 13/02; H01R 4/28; H01R 25/162; H01R 25/161; H01R 25/16; H01R 25/14; H01R 9/2658
USPC ..... 439/816
See application file for complete search history.

(56) References Cited

U.S. PATENT DOCUMENTS 4,734,041 A * 3/1988 Bruchmann ..... H01R 12/82 439/924.1
4,983,132 A * 1/1991 Weidler ..... H01R 25/162 439/786
5,052,953 A * 10/1991 Weber ..... H01R 12/718 439/857
6,102,754 A * 8/2000 Capper ..... H01R 13/113 439/857
6,645,012 B2 * 11/2003 Ito ..... H01R 12/721 439/862
6,652,322 B2 * 11/2003 Ito ..... H01R 12/721 439/857
6,921,301 B2 * 7/2005 Conrad ..... H01R 13/112 439/867
6,974,329 B2 * 12/2005 Henneberg ..... H01R 12/585 439/59
7,104,812 B1 * 9/2006 Bogiel ..... H01R 12/724 439/79

(Continued)

*Primary Examiner* — Harshad C Patel
(74) *Attorney, Agent, or Firm* — Barley Snyder

(57) ABSTRACT

A connector includes a pair of terminals. Each of the terminals includes a first sub-terminal having a first fixation part and a plurality of first elastic arms extending from the first fixation part, and a second sub-terminal having a second fixation part and a plurality of second elastic arms extending from the second fixation part. The first fixation part of the first sub-terminal is laminated on the second fixation part of the second sub-terminal, and the plurality of first elastic arms and the plurality of second elastic arms are alternately arranged in a row for electrically contacting with a shared bus bar.

17 Claims, 9 Drawing Sheets

(56) References Cited

U.S. PATENT DOCUMENTS

| | | | | |
|---|---|---|---|---|
| 7,347,722 | B2 * | 3/2008 | Zhang | G01R 11/04 439/858 |
| 7,476,108 | B2 * | 1/2009 | Swain | H01R 12/7088 439/947 |
| 7,726,982 | B2 * | 6/2010 | Ngo | H01R 12/716 439/79 |
| 8,926,375 | B2 * | 1/2015 | Chen | H01R 13/26 439/682 |
| 9,537,242 | B2 * | 1/2017 | Chen | H01R 13/18 |
| 11,211,734 | B2 * | 12/2021 | Hung | H01R 13/6276 |
| 2019/0089093 | A1 * | 3/2019 | Liu | H01R 13/187 |

* cited by examiner

CONNECTOR INCLUDING A TERMINAL WITH A PAIR OF SUB-TERMINALS

CROSS-REFERENCE TO RELATED APPLICATIONS

This application claims priority under 35 U.S.C. § 119 to Chinese Patent Application No. 202010311900.3 filed on Apr. 20, 2020.

FIELD OF THE INVENTION

The present disclosure relates to connectors, and more specifically, to an insulated electrical connector.

BACKGROUND

A power connector generally comprises an insulation housing and contacts, which include a positive contact and a negative contact provided in the insulation housing. The contacts are adapted to be in electrical contact with bus bars, which may include a positive bus bar and a negative bus bar inserted into the power connector. The contacts of the power connector are generally single-layer conductive contacts composed of a single-layer metal sheet. Such single-layer conductive contacts have defects such as high contact resistance and low current path density.

SUMMARY

According to an embodiment of the present disclosure, an electrical connector comprises a pair of terminals. Each of the terminals includes a first sub-terminal having a first fixation part (e.g., a first plate-like fixation part) and a plurality of first elastic arms extending from the first fixation part, and a second sub-terminal having a second fixation part (e.g., a second plate-like fixation part) and a plurality of second elastic arms extending from the second fixation part. The first fixation part of the first sub-terminal is laminated on the second fixation part of the second sub-terminal, and the plurality of first elastic arms and the plurality of second elastic arms are alternately arranged in a row for electrical contact with a shared bus bar.

BRIEF DESCRIPTION OF THE DRAWINGS

The invention will now be described by way of example with reference to the accompanying Figure, of which.

DETAILED DESCRIPTION OF THE EMBODIMENTS

Figure 1:
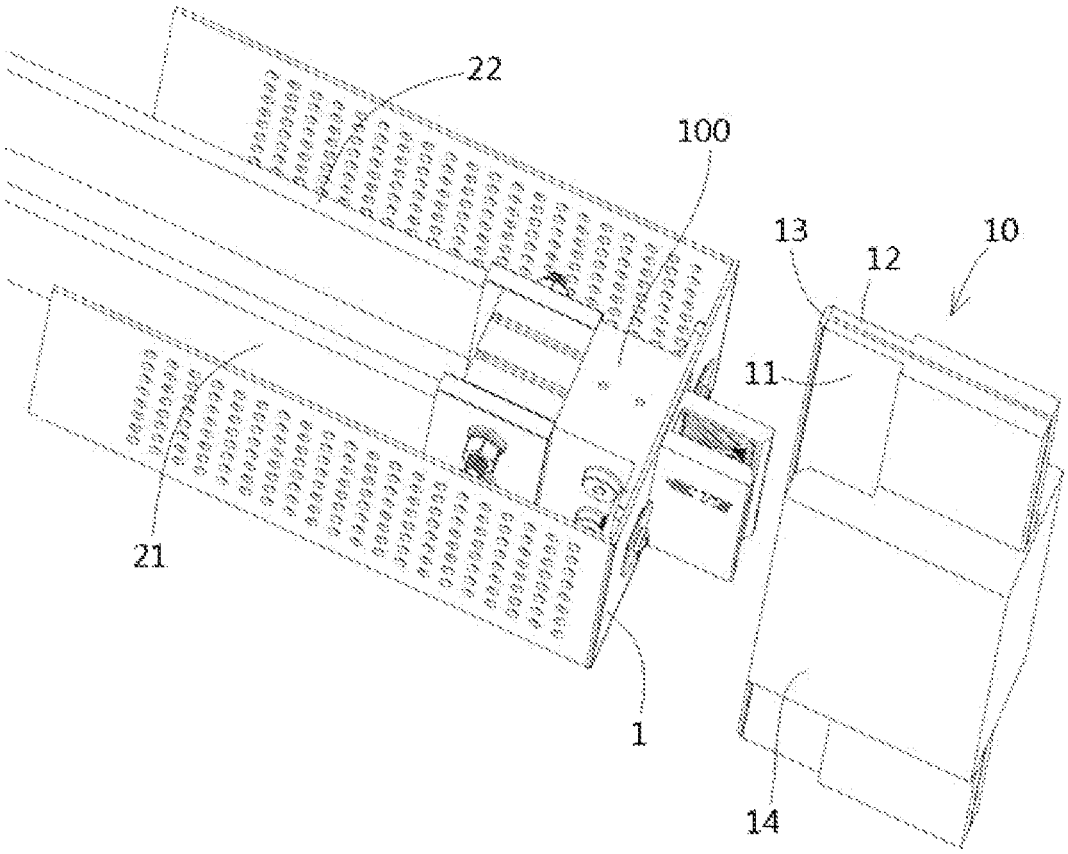
FIG. 1 is a schematic perspective diagram showing a connector according to an exemplary embodiment of the present disclosure, and a bus bar plug assembly connected to the connector.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a connector is provided comprising a pair of terminals. Each of the terminals includes a first sub-terminal having a first plate-like fixation part and a plurality of first elastic arms extending from the first plate-like fixation part, and a second sub-terminal having a second plate-like fixation part and a plurality of second elastic arms extending from the second plate-like fixation part. The first plate-like fixation part of the first sub-terminal is laminated on the second plate-like fixation part of the second sub-terminal, and the plurality of first elastic arms and the plurality of second elastic arms are alternately arranged in a row so as to be in electrical contact with a shared or common bus bar.

Figure 2:
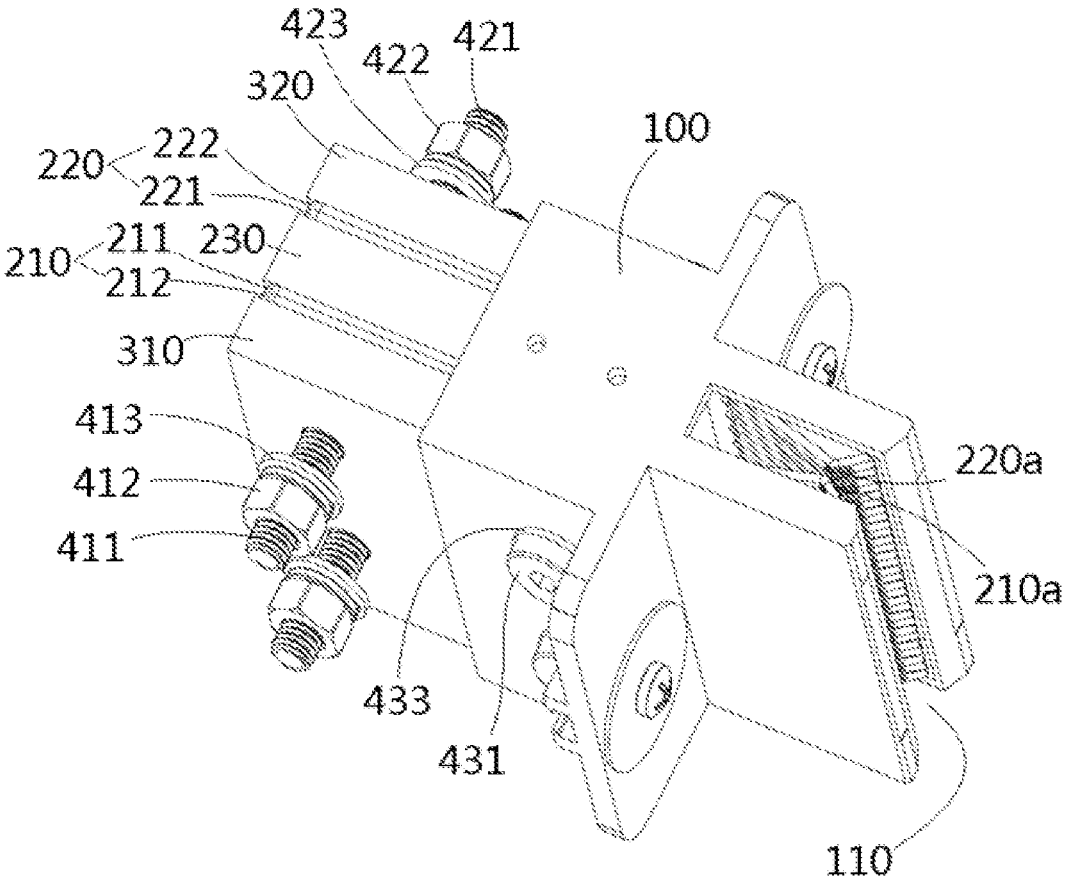
FIG. 2 shows a schematic perspective diagram of the connector shown in FIG. 1.

FIG. 1 shows a schematic perspective diagram of a power connector according to an exemplary embodiment of the present disclosure and a bus bar plug assembly 10 connected to the power connector. FIG. 2 shows a schematic perspective diagram of the power connector shown in FIG. 1.

In the illustrated embodiment, as shown in FIGS. 1 and 2, the connector comprises a pair of terminals 210, 220. One of the pair of terminals 210, 220 is a positive terminal 210 and the other is a negative terminal 220. The positive terminal 210 is used to electrically connect a first positive bus bar 11 and a second positive bus bar 21, and the negative terminal 220 is used to electrically connect a first negative bus bar 12 and a second negative bus bar 22.

Figure 3:
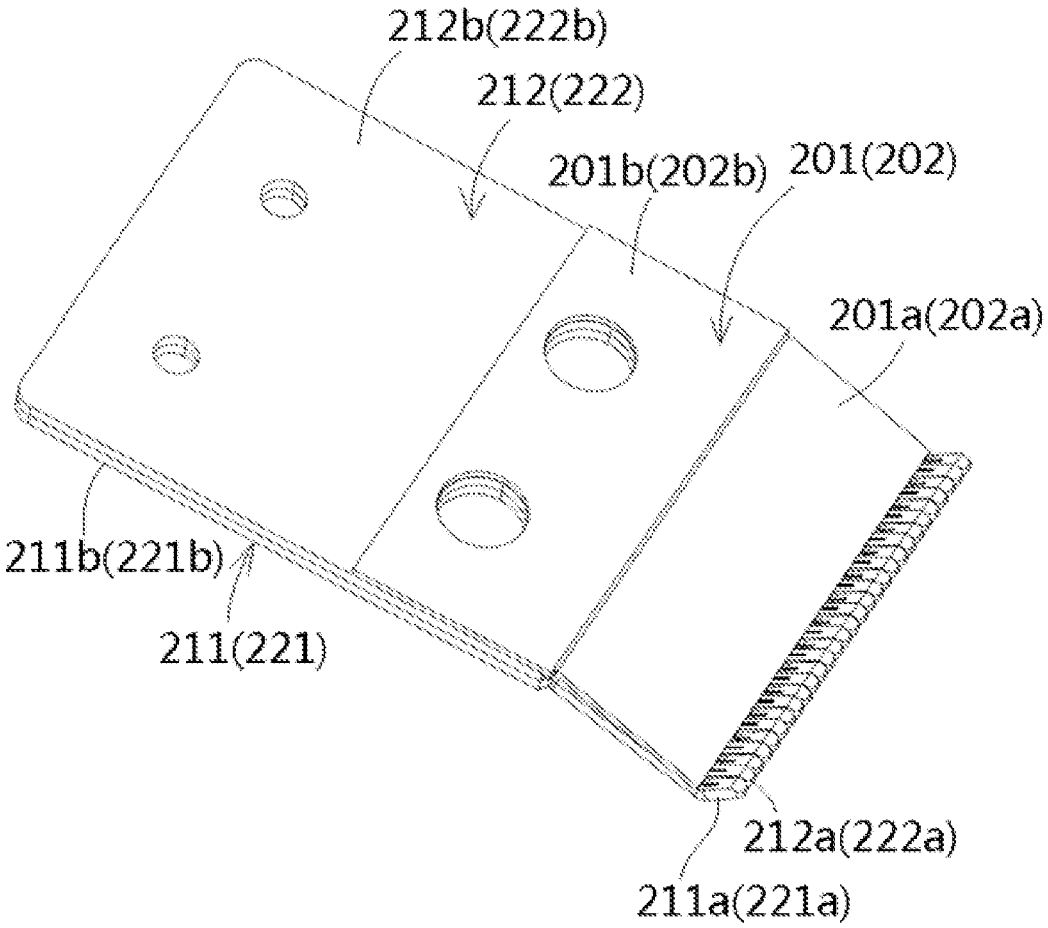
FIG. 3 shows a schematic perspective diagram of terminals and auxiliary terminals of the connector shown in FIG. 2.
Figure 4:
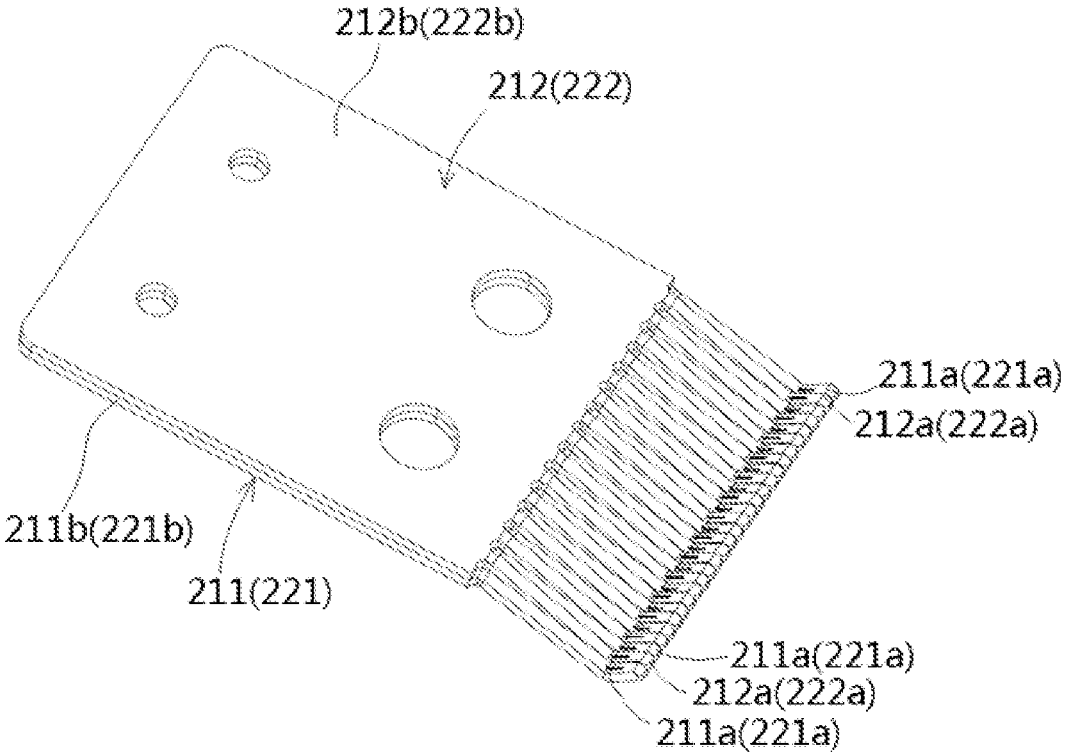
FIG. 4 shows a schematic perspective diagram of terminals of the connector shown in FIG. 3.
Figure 5:
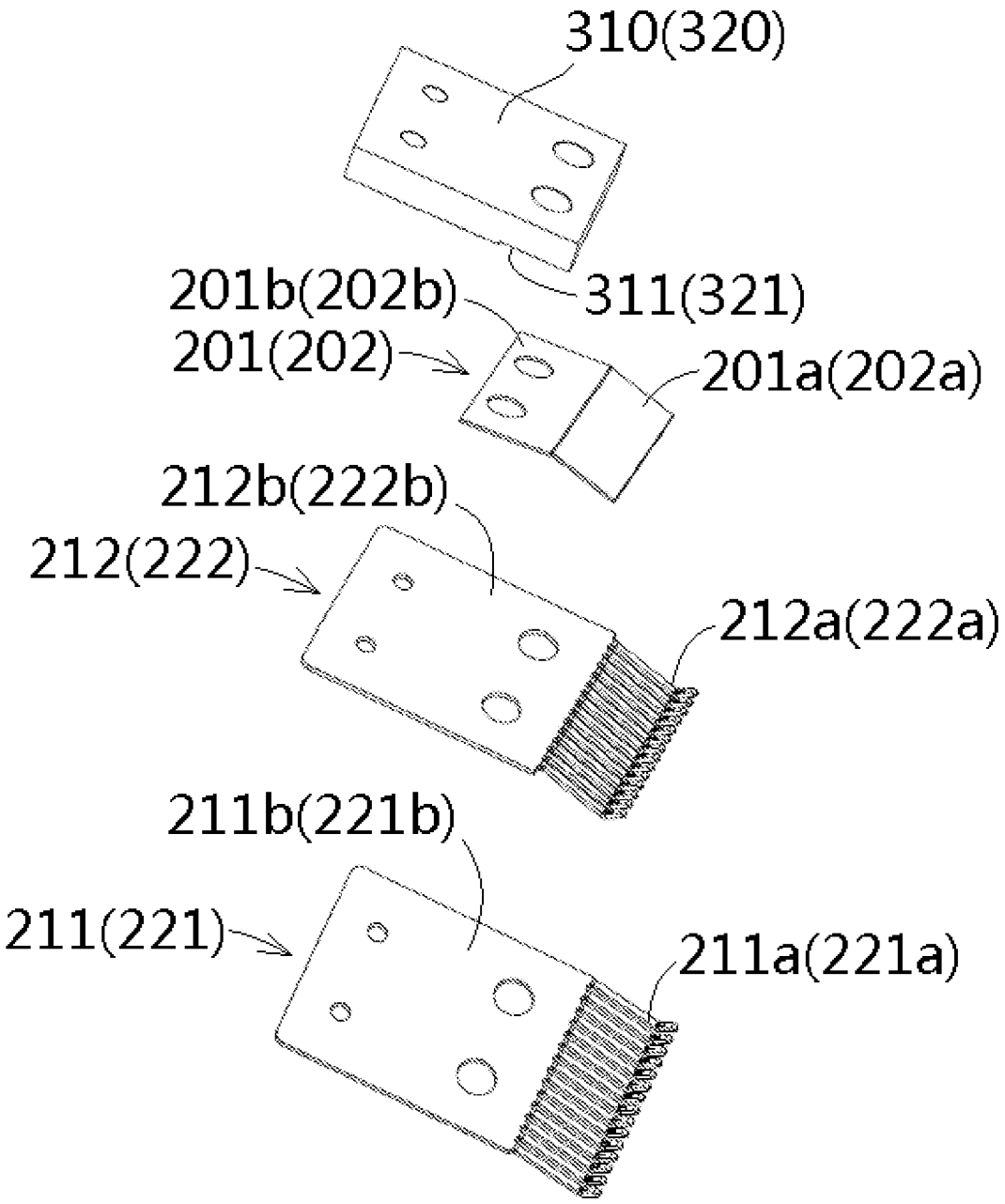
FIG. 5 shows a schematic exploded diagram of terminals, auxiliary terminals and conductive blocks of the connector shown in FIG. 2.
Figure 6:
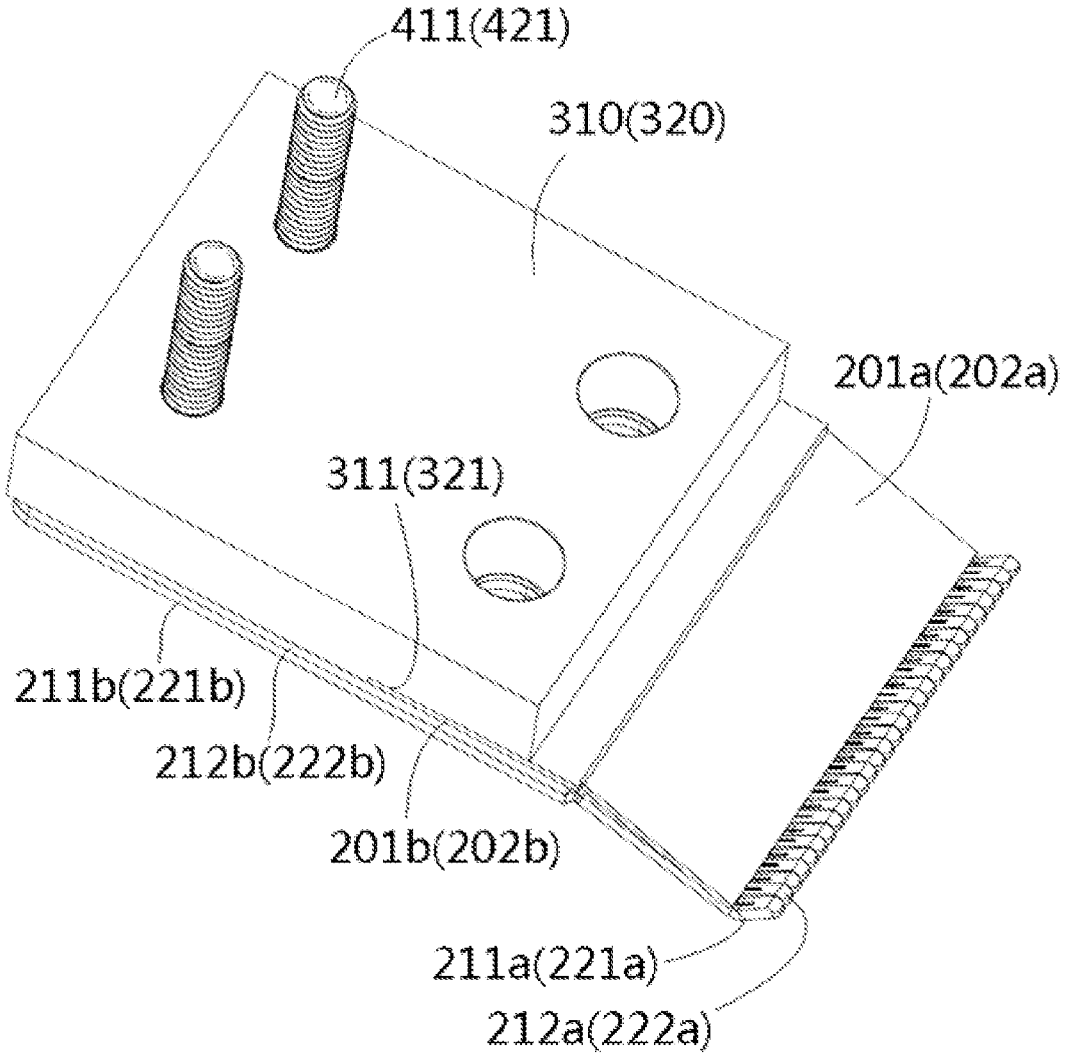
FIG. 6 shows a schematic assembly diagram of terminals, auxiliary terminals and conductive blocks of the connector shown in FIG. 2.

FIG. 3 shows a schematic perspective diagram of the terminals 210, 220 and auxiliary terminals 201, 202 of the connector shown in FIG. 2. FIG. 4 shows a schematic perspective diagram of the terminals of the connector shown in FIG. 3. FIG. 5 shows a schematic exploded diagram of the terminals, the auxiliary terminals and conductive blocks of the connector shown in FIG. 2. FIG. 6 shows a schematic assembly diagram of the terminals, the auxiliary terminals and conductive blocks of the connector shown in FIG. 2.

In the illustrated embodiment, as shown in FIGS. 1 to 6, each of the terminals 210, 220 comprises a first sub-terminal (211, 221) and a second sub-terminal (212, 222). The first sub-terminal (211, 221) has a first plate-like fixation part (211*b*, 221*b*) and a plurality of first elastic arms (211*a*, 221*a*)

extending from the first plate-like fixation part (211*b*, 221*b*). The second sub-terminal (212, 222) has a second plate-like fixation part (212*b*, 222*b*) and a plurality of second elastic arms (212*a*, 222*a*) extending from the second plate-like fixation part (212*b*, 222*b*).

In the illustrated embodiment, as shown in FIGS. 1 to 6, the first plate-like fixation part (211*b*, 221*b*) of the first sub-terminal (211, 221) is laminated on the second plate-like fixation part (212*b*, 222*b*) of the second sub-terminal (212, 222). The plurality of first elastic arms (211*a*, 221*a*) and the plurality of second elastic arms (212*a*, 222*a*) of each of the terminals 210, 220 are alternately arranged in a row for simultaneous electrical contact with the bus bar (11, 12). Thus, in the present disclosure, the contact impedance at the contact end of the connector is greatly reduced, and the current path density at the contact end of the connector is greatly increased.

In the illustrated embodiment, as shown in FIGS. 1 to 6, the connector further comprises a pair of auxiliary terminals 201, 202 laminated on outer sides of the pair of contacts (210, 220), respectively. Each of the auxiliary terminals 201, 202 have an auxiliary elastic arm (201*a*, 202*a*) abutting against the plurality of first elastic arms (211*a*, 221*a*) and the plurality of second elastic arms (212*a*, 222*a*) of the corresponding terminal (210, 220). Robustness of the entire terminal system is improved by the auxiliary elastic arms, and it is realized that the connector can still be in a contact state and transmit electric energy stably and reliably even in the case of great deviation or shaking.

Figure 7:
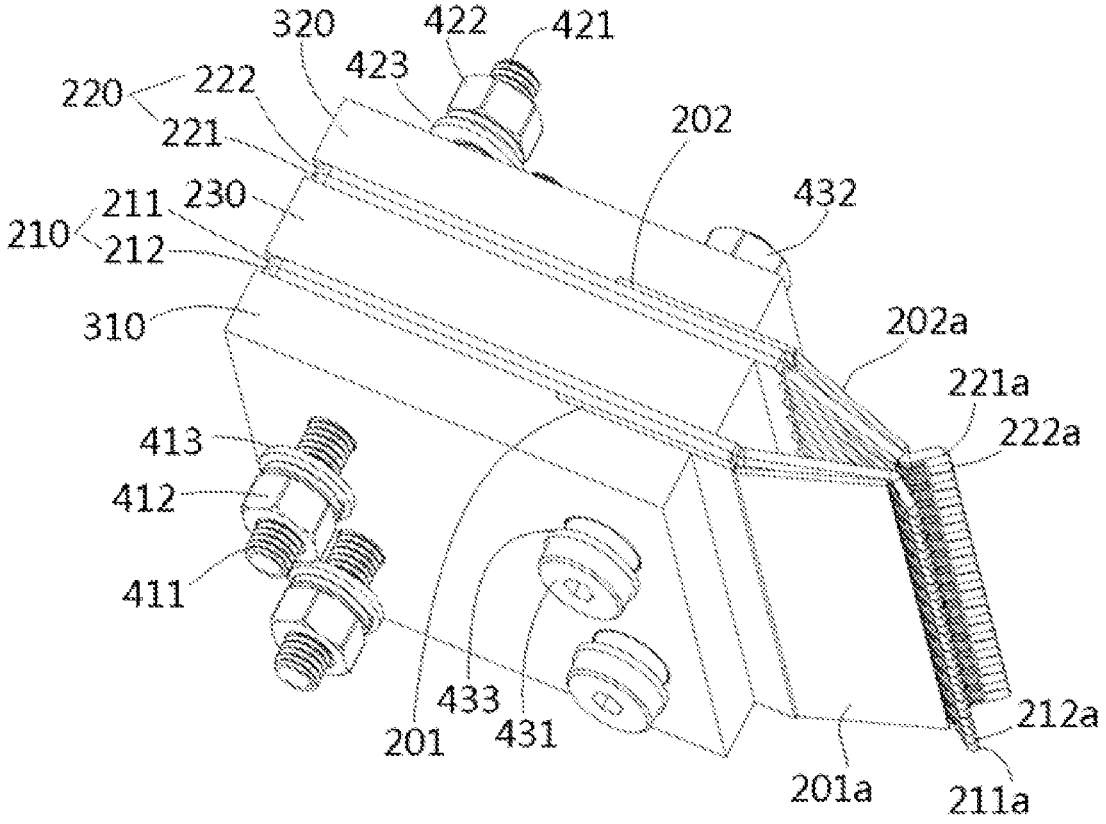
FIG. 7 shows a schematic perspective view of the connector shown in FIG. 2 with the insulation housing removed.
Figure 8:
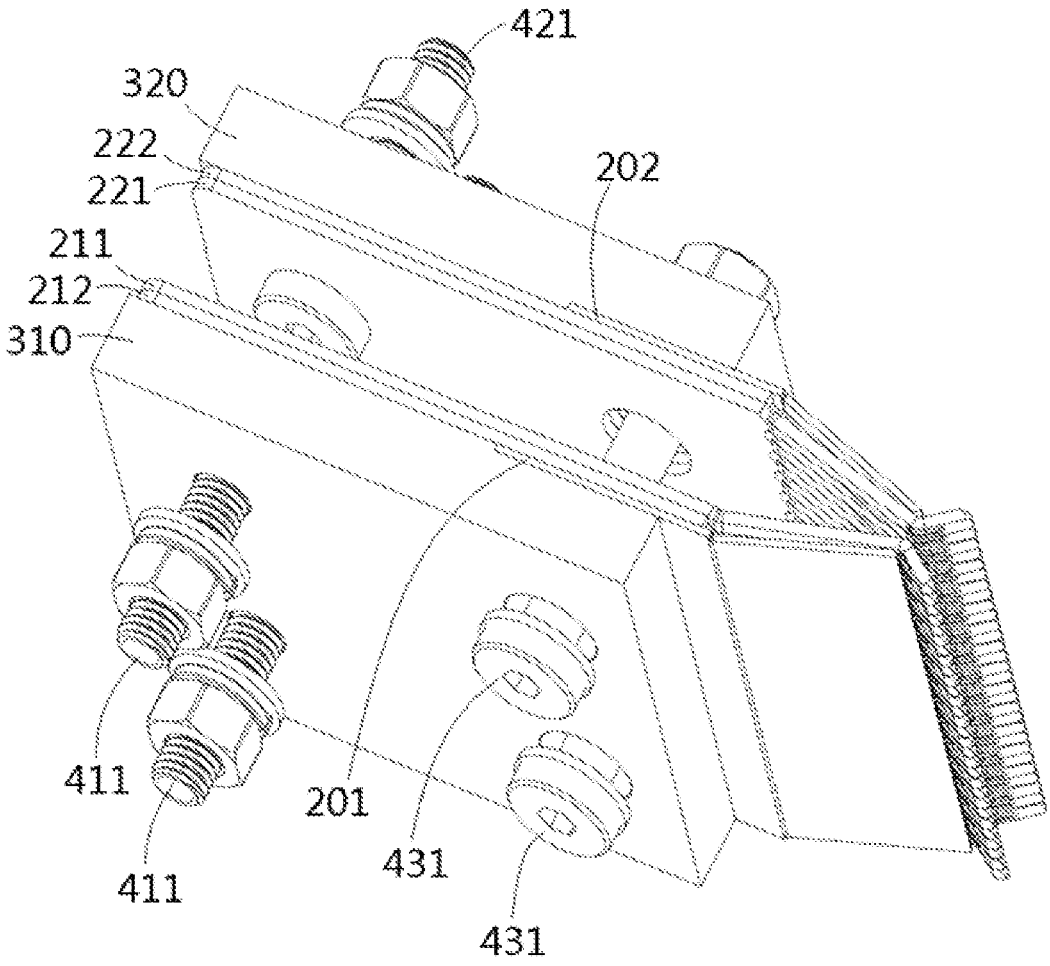
FIG. 8 shows a schematic perspective view of the connector shown in FIG. 7 with an insulation spacer removed.
Figure 9:
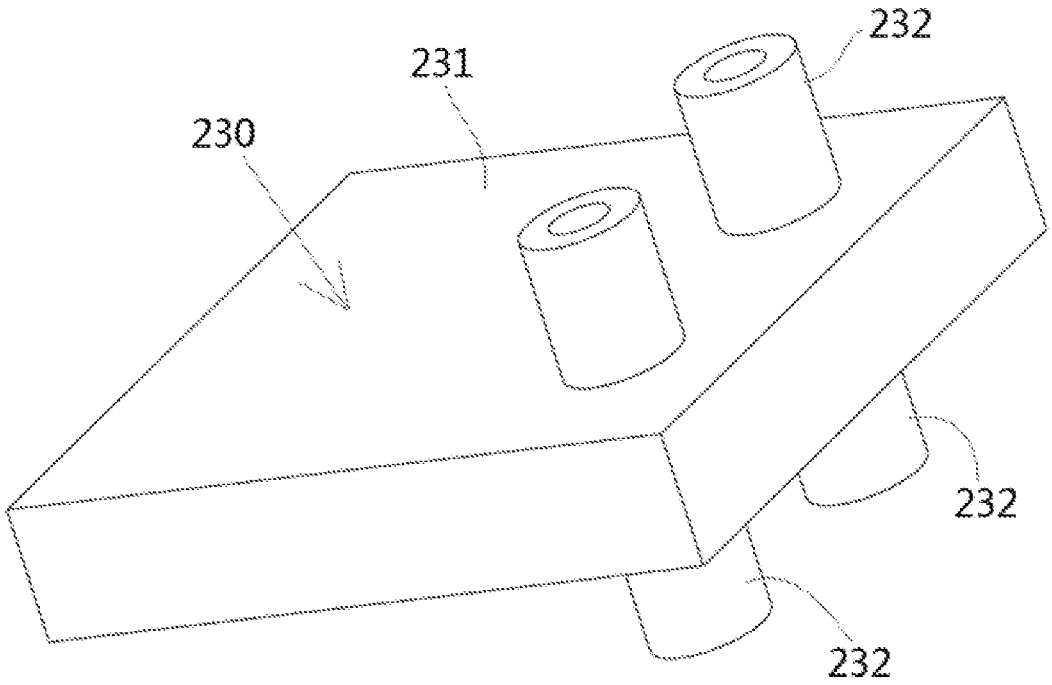
FIG. 9 shows a schematic perspective diagram of the insulation spacer of the connector shown in FIG. 7.

FIG. 7 shows a schematic perspective view of the connector shown in FIG. 2 with the insulation housing 100 removed. FIG. 8 shows a schematic perspective view of the connector shown in FIG. 7 with the insulation spacer 230 removed. FIG. 9 shows a schematic perspective diagram of the insulation spacer 230 of the connector shown in FIG. 7.

In the illustrated embodiment, as shown in FIGS. 1 to 9, the connector further comprises an insulation spacer 230 arranged between the pair of terminals 210, 220 for electrically isolating the pair of terminals 210, 220. The connector further comprises a pair of conductive blocks 310, 320, the insulation spacer 230, the pair of terminals 210, 220 and the pair of auxiliary terminals 201, 202 being clamped between the pair of conductive blocks 310, 320. The conductive blocks may realize the separable contact connection with the terminals; and the characteristics of the conductive block's low body resistance, good heat transfer and heat dissipation performance provide strong support for the connector to improve the current carrying capacity and heat transfer capacity. In the illustrated embodiment, thicknesses of the conductive blocks 310, 320 are greater than those of the terminals 210, 220. The length and width of the conductive blocks 310, 320 are approximately the same as those of the terminals 210, 220.

The auxiliary terminal (201, 202) further comprises a plate-like fixation part (201*b*, 202*b*) and an auxiliary elastic arm (201*a*, 202*a*) extending from the plate-like fixation part (201*b*, 202*b*). The plate-like fixation part (201*b*, 202*b*) of each of the auxiliary terminals 201, 202 is clamped between a corresponding one of the conductive blocks 310, 320 and a corresponding one of the terminals 210, 220. An inner surface of each of the conductive blocks 310, 320 is formed with a recess (311, 321) in which the plate-like fixation part (201*b*, 202*b*) of a corresponding one of the auxiliary contacts 201, 202 is positioned. Each of the conductive blocks 310, 320 is in electrical contact with the corresponding terminal (210, 220) and the corresponding auxiliary terminal (201, 202), simultaneously.

In the illustrated embodiment, as shown in FIGS. 1 to 9, the connector further comprises an insulation housing 100, the insulation spacer 230, the pair of terminals 210, 220, the pair of auxiliary terminals 201, 202, and the pair of conductive blocks 310, 320 being assembled in the insulation housing 100. The insulation housing 100 may be connected and fixed to a mounting panel 1 by a screw or a bolt.

In the illustrated embodiment, as shown in FIGS. 1 to 9, the connector further comprises bolt connection assemblies (431, 432, 433) connecting and fixing the insulation spacer 230, the pair of terminals 210, 220, the pair of auxiliary terminals 201, 202 and the pair of conductive blocks 310, 320 to the insulation housing 100. Each bolt connection assembly (431, 432, 433) comprises a bolt 431 and a nut 432, the bolt 431 passing through the insulation spacer 230, the pair of terminals 210, the pair of auxiliary terminals 201, 202, the pair of conductive blocks 310, 320 and the insulating housing 100 in a thickness direction, and being connected with the nut 432. In order to prevent the nut 432 from loosening, the bolt connection assembly (431, 432, 433) further comprises a lock washer 433 which may be placed between the nut 432 and the insulation housing 100, and/or between a head of the bolt 431 and the insulation housing 100.

In the illustrated embodiment, as shown in FIGS. 1 to 9, the insulation spacer 230 comprises a block-like insulation body 231 and cylindrical posts 232 protruding outward from two opposite sides of the block-like insulation body 231, the cylindrical posts 232 passing through the terminals 210, 220, the auxiliary terminals 201, 202 and the conductive blocks 310, 320, the bolt 431 passing through the cylindrical post 232. The cylindrical post 232 electrically isolates the bolt 431 from the terminals 210, 220, the auxiliary terminals 201, 202 and the conductive blocks 310, 320 to prevent the pair of terminals 210, 220 from being electrically connected together by the bolt 431.

In the illustrated embodiment, as shown in FIGS. 1 to 9, one side of the insulation housing 100 is formed with a slot 110, and the elastic arms 210*a*, 220*a* of the pair of terminals 210, 220 are located in the slot 110 and adapted to be in electrical contact with the first positive bus bar 11 and the first negative bus bar 12 on the bus bar plug assembly 10 inserted into the slot 110, respectively. The bus bar plug assembly 10 further comprises an insulation separator layer 13 provided between the first positive bus bar 11 and the first negative bus bar 12, the first positive bus bar 11 and the first negative bus bar 12 being formed on two opposite sides the insulation separator layer 13 respectively. Thus, it is convenient to insert the bus bar plug assembly into the slot 110 of the insulation housing 100. The bus bar plug assembly 10 also comprises an insulation shell 14, and the first positive bus bar 11 and negative bus bar 12 are assembled in the insulation shell 14.

In the illustrated embodiment, as shown in FIGS. 1 to 9, the connector further comprises a first connection assembly (411, 412, 413) and a second connection assembly (421, 422, 423). The first connection assembly (411, 412, 413) is used to electrically connect the positive terminal 210 to the second positive bus bar 21. The second connecting assembly (421, 422, 423) is used to electrically connect the negative terminal 220 to the second negative bus bar 22. The first connection assembly (411, 412, 413) comprises a first bolt 411 and a first nut 412, the first bolt 411 passing through the positive terminal 210, one conductive block 310 and the second positive bus bar 21 from inside to outside, and being threadedly connected with the first nut 412, so that the second positive bus bar 21 is electrically connected to the positive terminal 210 via the one conductive block 310. In order to prevent the first nut 412 from loosening, the first connection assembly (411, 412, 413) further comprises a first washer 413, which is placed between the first nut 412 and the second positive bus bar 21.

In the illustrated embodiment, as shown in FIGS. 1 to 9, the second connection assembly (421, 422, 423) comprises a second bolt 421 and a second nut 422, the second bolt 421 passing through the negative terminal 220, the conductive block 320 and the second negative bus bar 22 from inside to outside, and being threadedly connected with the second nut 422, so that the second negative bus bar 22 is electrically connected to the negative terminal 220 via the conductive block 320. In order to prevent the second nut 422 from loosening, the second connecting assembly (421, 422, 423) further comprises a second washer 423, which is placed between the second nut 422 and the second negative bus bar 22.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector comprising:

a pair of terminals, each of the terminals including:

a first sub-terminal having a first plate-like fixation part and a plurality of first elastic arms extending from the first plate-like fixation part; and a second sub-terminal having a second plate-like fixation part and a plurality of second elastic arms extending from the second plate-like fixation part, the first plate-like fixation part of the first sub-terminal is laminated on the second plate-like fixation part of the second sub-terminal, and the plurality of first elastic arms and the plurality of second elastic arms are alternately arranged in a row for electrically contacting a bus bar;

a pair of auxiliary terminals laminated on outer sides of the pair of terminals, respectively, wherein each of the auxiliary terminals has an auxiliary elastic arm arranged to abut against the plurality of first elastic arms and the plurality of second elastic arms of a corresponding one of the terminals;

an insulation spacer arranged between the pair of terminals and configured for electrically isolating the pair of terminals; and a pair of conductive blocks, the insulation spacer, the pair of terminals and the pair of auxiliary terminals being clamped between the pair of conductive blocks.

2. The connector according to claim 1, wherein thicknesses of the conductive blocks are greater than those of the terminals.

3. The connector according to claim 1, wherein each of the auxiliary terminals further includes a plate-like fixation part and an auxiliary elastic arm extending from the plate-like fixation part, the plate-like fixation part of each of the auxiliary terminals is clamped between a corresponding one of the conductive blocks and a corresponding one of the terminals.

4. The connector of claim 3, wherein an inner surface of each of the conductive blocks is formed with a recess in which the plate-like fixation part of a corresponding one of the auxiliary terminals is positioned.

5. The connector according to claim 1, wherein each of the conductive blocks is in electrical contact with both of a corresponding one of the terminals and a corresponding one of the auxiliary terminals.

6. The connector according to claim 1, further comprising an insulation housing, the insulation spacer, the pair of terminals, the pair of auxiliary terminals, and the pair of conductive blocks being assembled in the insulation housing.

7. The connector according to claim 6, further comprising a bolt connection assembly connecting and fixing the insulation spacer, the pair of terminals, the pair of auxiliary terminals and the pair of conductive blocks to the insulation housing.

8. The connector according to claim 7, wherein the bolt connection assembly comprises a bolt and a nut, the bolt passing through the insulation spacer, the pair of terminals, the pair of auxiliary terminals, the pair of conductive blocks and the insulating housing in a thickness direction, and being connected with the nut.

9. The connector according to claim 8, wherein the insulating spacer includes a block-like insulation body and a cylindrical post protruding outward from two opposite sides of the block-like insulation body, the cylindrical post passing through the terminals, the auxiliary terminals and the conductive blocks, the bolt passing through the cylindrical post, the cylindrical post electrically isolates the bolt from the terminals, the auxiliary terminals and the conductive blocks to prevent the pair of terminals from being electrically connected together by the bolt.

10. The connector of claim 6, wherein one of the pair of terminals is a positive terminal, and the other is a negative terminal, one side of the insulation housing is formed with a slot, and the elastic arms of the pair of terminals are located in the slot and adapted to be in electrical contact with a first positive bus bar and a first negative bus bar on a bus bar plug assembly inserted into the slot, respectively.

11. The connector of claim 10, further comprising:

a first connection assembly for electrically connecting the positive terminal to a second positive bus bar; and a second connection assembly for electrically connecting the negative terminal to a second negative bus bar.

12. The connector of claim 11, wherein the first connection assembly includes a first bolt and a first nut, the first bolt passing through the positive terminal, one of the conductive blocks and the second positive bus bar from inside to outside, and being threadedly connected with the first nut, so that the second positive bus bar is electrically connected to the positive terminal via the one conductive block.

13. The connector of claim 12, wherein the second connection assembly comprises a second bolt and a second nut, the second bolt passing through the negative terminal, the other conductive block and the second negative bus bar from inside to outside, and being threadedly connected with the second nut, so that the second negative bus bar is electrically connected to the negative contact via the other conductive block.

14. A connector comprising:

a pair of terminals, each of the terminals including:

a first sub-terminal having a first fixation part and a plurality of first elastic arms extending from the first fixation part; and a second sub-terminal having a second fixation part and a plurality of second elastic arms extending from the second fixation part, the first fixation part of the first sub-terminal is attached to the second fixation part of the second sub-terminal such that the plurality of first elastic arms and the plurality of second elastic arms are alternately arranged in a row;

a pair of auxiliary terminals laminated on outer sides of the pair of terminals, respectively, wherein each of the auxiliary terminals has an auxiliary elastic arm arranged to abut against the plurality of first elastic arms and the plurality of second elastic arms of a corresponding one of the terminals;

an insulation spacer arranged between the pair of terminals and configured for electrically isolating the pair of terminals; and a pair of conductive blocks, the insulation spacer, the pair of terminals and the pair of auxiliary terminals being clamped between the pair of conductive blocks.

15. The connector according to claim 14, further comprising:

an insulation housing; and a pair of auxiliary terminals attached on respective outer sides of the pair of terminals, each of the auxiliary terminals including an auxiliary elastic arm arranged to abut against the plurality of first elastic arms and the plurality of second elastic arms of a corresponding one of the terminals, the pair of terminals and the pair of auxiliary terminals assembled in the insulation housing.

16. The connector of claim 15, wherein one of the pair of terminals is a positive terminal, and the other is a negative terminal, one side of the insulation housing is formed with a slot, and the elastic arms of the pair of terminals are located in the slot and adapted to be in electrical contact with a first positive bus bar and a first negative bus bar on a bus bar plug assembly inserted into the slot, respectively.

17. The connector of claim 16, further comprising:

a first connection assembly for electrically connecting the positive terminal to a second positive bus bar; and a second connection assembly for electrically connecting the negative terminal to a second negative bus bar.

* * * * *